US008534988B2

(12) United States Patent
Zhang et al.

(10) Patent No.: US 8,534,988 B2
(45) Date of Patent: Sep. 17, 2013

(54) FAN ASSEMBLY

(75) Inventors: Guang-Yi Zhang, Shenzhen (CN); Zhe Zhang, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 486 days.

(21) Appl. No.: 12/965,829

(22) Filed: Dec. 11, 2010

(65) Prior Publication Data

US 2012/0138262 A1 Jun. 7, 2012

(30) Foreign Application Priority Data

Dec. 6, 2010 (CN) ..... 2010 1 0574830

(51) Int. Cl.
*F04D 27/00* (2006.01)

(52) U.S. Cl.
USPC ..... 415/26; 415/211.2

(58) Field of Classification Search
USPC ..... 415/26, 148, 182.1, 208.1, 211.2; 416/40, 44; 454/184, 259, 353, 359
See application file for complete search history.

(56) References Cited

U.S. PATENT DOCUMENTS

| | | | | | |
|---|---|---|---|---|---|
| 2,037,857 | A * | 4/1936 | Fox | 454/161 |
| 2,186,142 | A * | 1/1940 | Lieberman | 5/284 |
| 2,279,425 | A * | 4/1942 | Voysey | 415/146 |
| 3,536,413 | A * | 10/1970 | Omiya et al. | 415/211.2 |
| 3,917,433 | A * | 11/1975 | Tomitaka | 415/148 |
| 4,653,384 | A * | 3/1987 | Amano | 454/319 |
| 6,229,701 | B1 * | 5/2001 | Kung et al. | 361/688 |
| 6,837,785 | B2 * | 1/2005 | Soderlund | 454/184 |
| 7,416,481 | B2 * | 8/2008 | Baker et al. | 454/184 |
| 7,731,477 | B2 * | 6/2010 | Erni | 415/126 |
| 8,120,910 | B2 * | 2/2012 | Hong | 361/695 |

* cited by examiner

*Primary Examiner* — Edward Look
*Assistant Examiner* — Christopher J Hargitt
(74) *Attorney, Agent, or Firm* — Altis Law Group, Inc.

(57) ABSTRACT

A fan assembly includes a mounting bracket, a fan, and a baffle. The mounting bracket includes two side plates bounding an outlet, and each side plate defines a through hole. An inner side bounding the through hole defines an arc-shaped cutout, communicating with the through hole. The baffle includes two pins rotatably received in the through holes of the side plates. A protrusion protrudes out from each pin, and is engaged in the corresponding cutout. When the fan operates, the baffle is pushed to rotate to open the outlet, to allow air from the fan to flow out through the outlet. When the fan ceases operation, the baffle rotates back under force of gravity to a position to cover the outlet, where the protrusion resists against one end of the cutout such that further rotation is prevented, to prevent air intake into the mounting bracket through the outlet.

8 Claims, 5 Drawing Sheets

FAN ASSEMBLY

BACKGROUND

1. Technical Field

The present disclosure relates to fan assemblies, and particularly to a fan assembly with anti-backflow function.

2. Description of Related Art

Electronic devices, such as computers, use heat dissipation assemblies for dissipating heat generated by components therein, thus preventing the components from becoming overheated. The heat dissipation assembly mainly includes a plurality of fan assemblies blowing air to dissipate heat in the electronic devices. However, if one of the fan assemblies breaks down and ceases operation, the exhausted heat can be sucked back into the electronic devices by the fan assembly because the other fan assemblies are still in operation, which could lead to damaging overheating of components.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure, including the accompanying drawings, is illustrated by way of examples and not by way of limitation. It should be noted that references to "an" or "one" embodiment in this disclosure are not necessarily to the same embodiment, and such references mean at least one.

Figure 1:
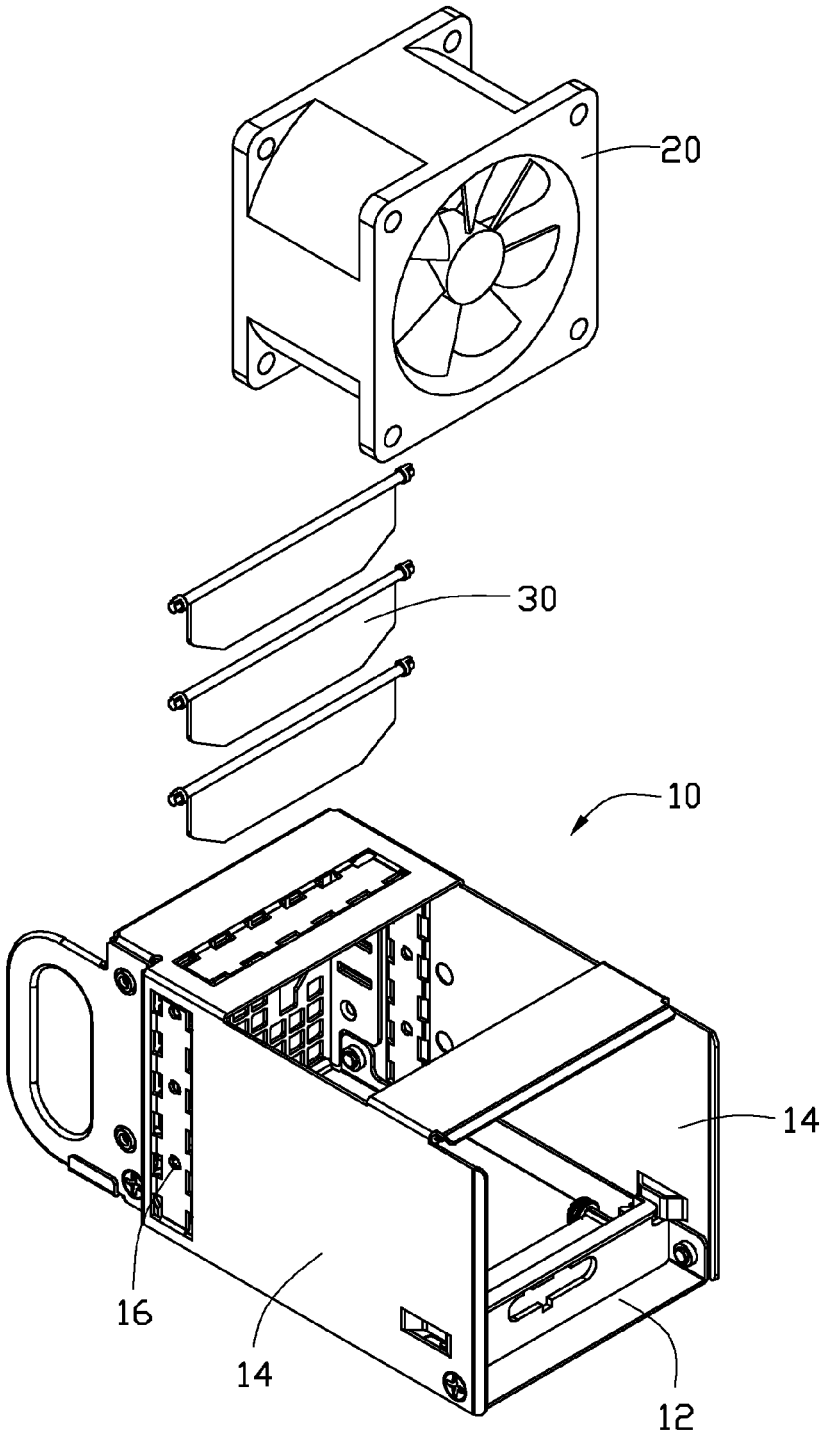
FIG. 1 is an exploded, isometric view of a fan assembly including a mounting bracket and a plurality of baffles mounted to the mounting bracket.

Referring to FIG. 1, a fan assembly includes a mounting bracket 10, a fan 20 mounted to the mounting bracket 10, and a plurality of baffles 30.

Figure 2:
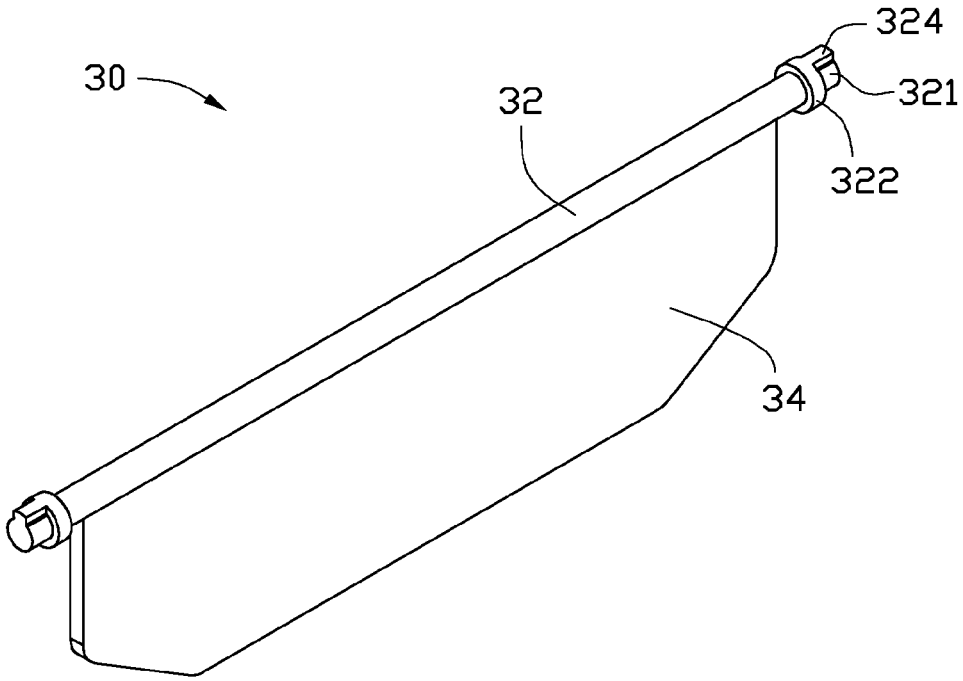
FIG. 2 is an enlarged view of one of the baffles of FIG. 1.

Referring to FIG. 2, each baffle 30 includes a shaft 32 and a blocking piece 34 radially extending from a circumference of the shaft 32 along the length thereof. Two flanges 322 are formed at opposite distal ends of the shaft 32. A pin 321 extends from each flange 322 along an axis of the shaft 32. A protrusion 324 protrudes out from each pin 321, and extends to be connected to the corresponding flange 322.

Figure 3:
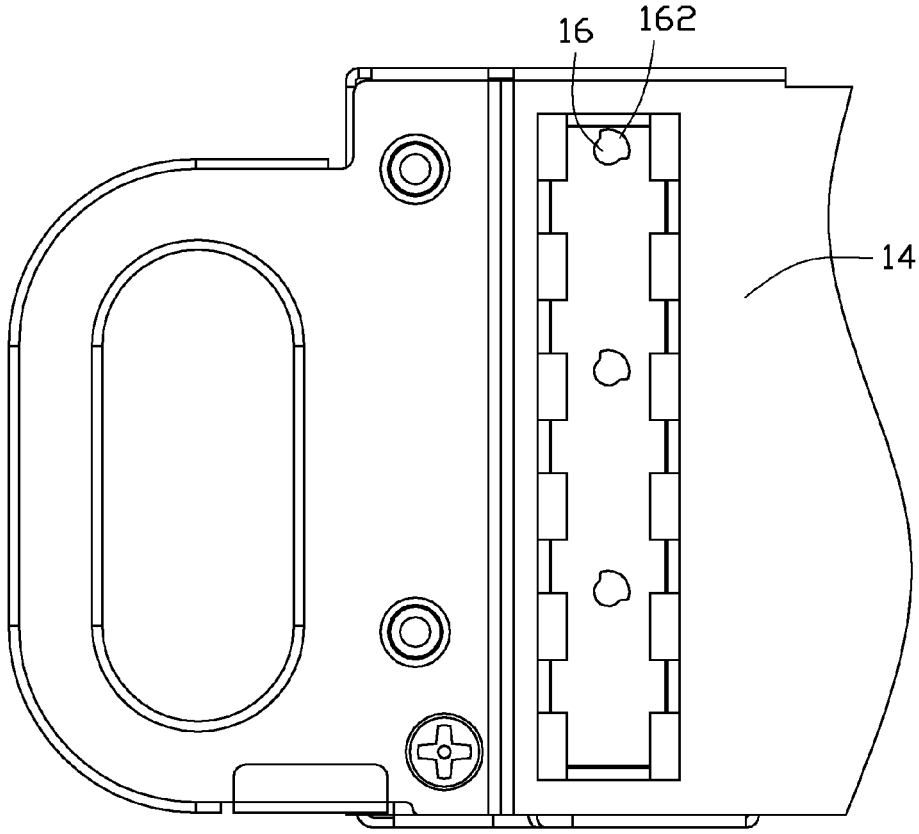
FIG. 3 is a partial, enlarged side view of the mounting bracket of FIG. 1.

Referring to FIGS. 1 and 3, the mounting bracket 10 includes a bottom plate 12, and two side plates 14 extending up from opposite sides of the bottom plate 12. The bottom plate 12 and the side plates 14 jointly bound an outlet 11 (labeled in FIG. 4). Each side plate 12 defines a plurality of through holes 16 aligned in a line perpendicular to the bottom plate 12, adjacent to the outlet 11. An inner side bounding each through hole 16 defines an arc-shaped cutout 162, communicating with the corresponding through hole 16.

Figure 4:
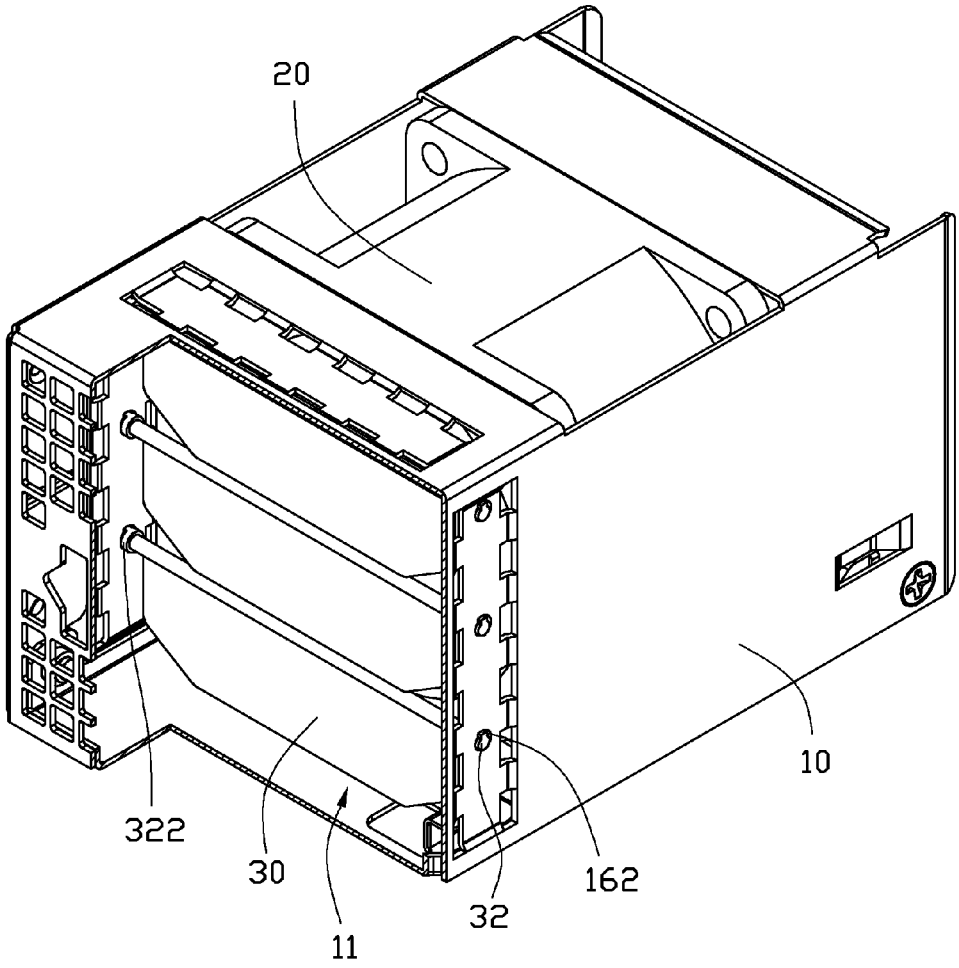
FIG. 4 is an assembled, isometric view of the fan assembly of FIG. 1, but viewed from another perspective and the mounting bracket partially cut away.

Referring to FIG. 4, in assembly, the pins 321 of each baffle 30 are pivotably engaged in the corresponding through holes 16 of the side plates 14, with the protrusions 324 of the baffle 30 received in the corresponding cutouts 162. At this time, a bottom of the blocking piece 34 of one baffle 30 overlaps the shaft 32 of an adjacent baffle 30, to cover the outlet 11. Each protrusion 324 resists against a first end of the corresponding cutout 162, adjacent to the outlet 11. The fan 20 is accommodated in the mounting bracket 10, sandwiched between the side plates 14, and supported on the bottom plate 12, facing the baffles 30.

Figure 5:
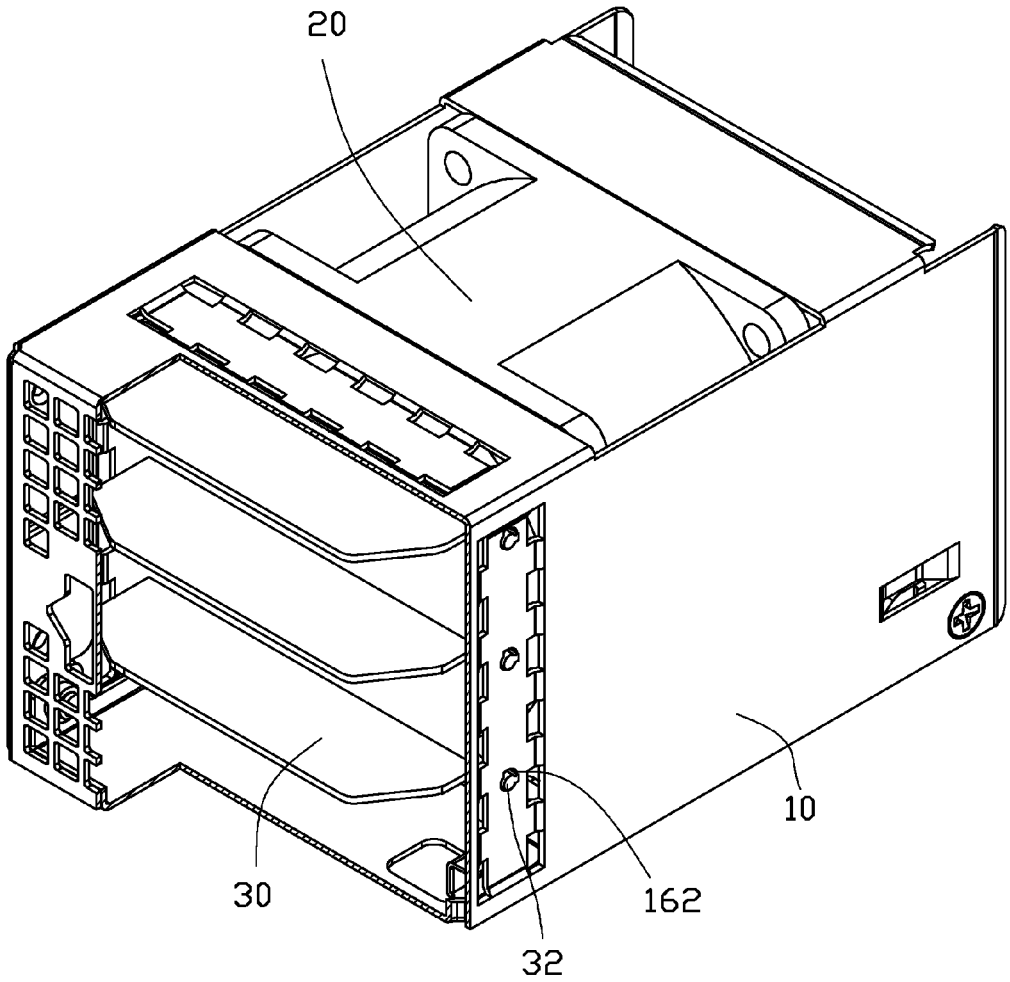
FIG. 5 is a using state view of FIG. 4.

Referring to FIG. 5, in use, as the fan 20 operates, the heated air from the fan 20 will push the baffles 30 to rotate to uncover the outlet 11. Therefore, the baffles 30 are rotated around the shafts 32, to open the outlet 11 of the mounting bracket 10, so that the heat can be exhausted out the outlet 11. In this process, the pins 321 of the baffles 30 are rotated in the through holes 16 of the mounting bracket 10, and the protrusions 324 move in the corresponding cutouts 162. When the protrusions 324 resist against second ends of the corresponding cutouts 162, away from the outlet 11, the baffles 30 cannot rotate further. If the fan 20 ceases operation, the baffles 30 automatically rotate back under force of gravity to a closed position to cover the outlet 26. Each protrusion 324 resists against the first end of the corresponding cutout 162, adjacent to the outlet 11, to prevent air intake through the outlet 11.

It is believed that the present embodiments and theirs advantages will be understood from the foregoing description, and they will be apparent that various changes may be made thereto without departing from the spirit and scope of the description or sacrificing all of their material advantages, the examples hereinbefore described merely being exemplary embodiment.

What is claimed is:

1. A fan assembly comprising:

a mounting bracket comprising two side plates bounding an outlet, each side plate defining a through hole, an inner side bounding the through hole defining an arc-shaped cutout, communicating with the through hole;

a fan mounted in the mounting bracket, between the side plates; and a baffle pivotably mounted to the side plates at the outlet, wherein the baffle comprises two pins pivotably received in the through holes of the side plates, correspondingly, a protrusion protrudes out from each pin to be engaged in the cutouts, wherein when the fan operates, the baffle is pushed by air from the fan to rotate to uncover the outlet, to allow the air from the fan to flow out of the mounting bracket through the outlet; when the fan ceases operation, the baffle rotates under force of gravity to a position to cover the outlet, where the protrusion resists against one end of the cutout such that further rotation is prevented, to prevent air intake into the mounting bracket through the outlet through the outlet.

2. The fan assembly of claim 1, wherein the baffle comprises a shaft and a blocking piece extending from a circumference of the shaft, the pins extend from opposite ends of the shaft, the blocking piece is configured to cover or open the outlet.

3. The fan assembly of claim 2, wherein two flanges are formed at the opposite ends of the shaft, the pins extend from the flanges along an axis of the shaft, correspondingly.

4. The fan assembly of claim 3, wherein the flanges abut against inner sidewalls of the side plates, each protrusion is connected to the corresponding flange.

5. The fan assembly of claim 1, wherein the mounting bracket further comprises a bottom plate, the side plates extend from opposite sides of the bottom plate, correspondingly, the fan is supported on the bottom plate, and sandwiched between the side plates, facing the baffle.

6. A fan assembly comprising:

a mounting bracket comprising two side plates bounding an outlet, each side plate defining a plurality of through holes, an inner side bounding each of the through holes defining an arc-shaped cutout, communicating with the through hole;

a fan mounted in the mounting bracket, between the side plates; and a plurality of baffles pivotably mounted to the side plates at the outlet via the plurality of through holes, wherein each of the baffles comprises two pins pivotably received in corresponding two of the through holes of the side plates, a protrusion protrudes out from each pin to be engaged in the corresponding cutout, wherein when the fan operates, the plurality of baffles is pushed by air from the fan to rotate to uncover the outlet, to allow the air from the fan to flow out of the mounting bracket through the outlet; and when the fan ceases operation, the baffle rotates under force of gravity to a position to cover the outlet, where each of the protrusions resists against one end of the cutout away such that further rotation is prevented, to prevent air intake into the mounting bracket through the outlet through the outlet.

7. The fan assembly of claim 6, wherein each baffle comprises a shaft and a blocking piece extending from a circumference of the shaft, the pins extend from opposite ends of the shaft, the blocking piece is configured to cover or open the outlet.

8. The fan assembly of claim 7, wherein a bottom of the blocking piece of one baffle overlaps the shaft of an adjacent baffle, to cover the outlet.

* * * * *